US005093555A

United States Patent [19]

Dupuis et al.

[11] Patent Number: 5,093,555

[45] Date of Patent: Mar. 3, 1992

[54] GLOW PLUG HAVING COBALT/IRON ALLOY REGULATING FILAMENT

[75] Inventors: Bertram Dupuis; Max Endler, both of Ludwigsburg; Paul Bauer, Steinheim, all of Fed. Rep. of Germany

[73] Assignees: BERU Ruprecht GmbH & Co. KG; Vacuumschmelze GmbH, both of Fed. Rep. of Germany

[21] Appl. No.: 384,632

[22] Filed: Jul. 21, 1989

[30] Foreign Application Priority Data

Jul. 22, 1988 [DE] Fed. Rep. of Germany ..... 3825012

[51] Int. Cl.[5] ..... F23Q 7/00; H05B 3/12; H05B 1/02; H01C 3/04

[52] U.S. Cl. ..... 219/270; 123/145 A; 219/553; 338/22 R

[58] Field of Search ..... 219/260–270, 219/552, 553; 361/266; 123/145 R, 145 A; 338/308, 22 R

[56] References Cited

U.S. PATENT DOCUMENTS

| | | | |
|---|---|---|---|
| 4,168,344 | 9/1979 | Shapiro et al. | 338/308 X |
| 4,423,309 | 12/1983 | Murphy et al. | 219/270 |
| 4,556,781 | 12/1985 | Bauer | 219/270 |
| 4,636,614 | 1/1987 | Itoh et al. | 219/270 |

FOREIGN PATENT DOCUMENTS

| | | | |
|---|---|---|---|
| 2115620 | 10/1972 | Fed. Rep. of Germany . | |
| 2539841 | 3/1977 | Fed. Rep. of Germany . | |
| 2802625 | 7/1979 | Fed. Rep. of Germany . | |
| 57-115622 | 7/1982 | Japan | 219/270 |
| 57-115623 | 7/1982 | Japan | 219/270 |
| 58-83124 | 5/1983 | Japan | 219/270 |
| 254482 | 7/1926 | United Kingdom . | |
| 2216952 | 10/1989 | United Kingdom | 219/270 |

OTHER PUBLICATIONS

"Bosch Techn Berichte" (Bosch Technical Reports) 5, 1977 by H. Weil, pp. 279–286.

*Primary Examiner*—Anthony Bartis

*Attorney, Agent, or Firm*—Sixbey, Friedman, Leedom & Ferguson

[57] ABSTRACT

A sheathed-element glow plug has a front resistance heating filament connected in series with a rear resistance regulating filament having a higher positive temperature coefficient (PTC) than the front filament. The rear filament is made of cobalt/iron alloy consisting of 44–80% by weight cobalt, 20–35% by weight iron, up to 1% miscellaneous components and nickel, if present, in an amount of 0 to less than 15% by weight. The alloy has a resistance ratio (20°–1000° C.) which is no more than approximately 7.5 in the range from about 100° C. to between about 400° C. to about 600° C., and which ratio rises sharply to values from 7.5 to greater thin 12 in the range from 400° C. to 600° C. to about 900° C.

10 Claims, 5 Drawing Sheets

GLOW PLUG HAVING COBALT/IRON ALLOY REGULATING FILAMENT

The invention relates to a material for an electrical resistance element having a high positive temperature coefficient of electrical resistance.

Materials for electrical resistance elements having a positive temperature coefficient PTC in the electrical resistance have an electrical resistance which increases as the temperature rises. When a voltage is applied, a comparatively high current flows initially and then abates with increasing heating of the resistance element. Thus, there is a certain self-regulating effect. For this reason, materials for resistance elements with a positive temperature coefficient in the electric resistor are frequently used for regulating or heating elements. By reason of their initially low resistance, they permit of a high heating-up rate. Due to the limiting of the current with rising temperature due to the positive temperature coefficient of the electrical resistance, damage to the resistance element or its environment can be prevented even at high heating-up rates.

An electrical resistance heating element consisting of a material with a high positive temperature coefficient of the electrical resistance is known for example from DE-OS 25 39 841. The material mentioned therein is nickel. In addition, the same specification discloses the use of the element for temperature-operated switches.

Furthermore, several patent specifications mention the use of the regulating behaviour of resistance elements having a high positive temperature coefficient of the electrical resistance in glow plugs for diesel engines. Arrangements comprising resistance elements according to the state of the art are known for example from DE-PS 28 02 625, DE-OS 21 15 620 or GB-PS 254 482 as well as from the article by H. Weil in "Bosch Techn. Berichte" (Bosch Technical Reports), 5 (1977), pp. 279–286. Appropriate materials disclosed in GB-PS 254 482 are iron, nickel and platinum. The use of a nickel-iron alloy is known from DE-OS 2 115 620.

SUMMARY OF THE INVENTION

The invention involves a material for an electrical resistance element having a positive temperature coefficient as well a sheathed-element glow plug which uses the material as a regulating element, wherein the electrical resistance of the material increases as the temperature rises so that, when voltage is applied to the electrical resistance element, initially, a comparatively high current flow occurs which abates with increased heating of the electrical resistance element. To allow faster heat-up rate and a higher degree of regulation, in accordance with the invention, the material has been designed to have a resistance temperature factor which results in an initial nonlinear rise in resistance that is gradual in comparison to a following steep rise in resistance with increases in temperature above 750° C. with an abrupt transition therebetween; for example, the resistance ratio sharply increase from a value of no more than 7.5 to a ration in excess of 12.

In accordance with preferred embodiments described below, the material comprises an cobalt-iron alloy which exhibits a cubically three-dimensionally centered structure at room temperature that merges into a cubically two-dimensionally centered structure as it is heated from room temperature up to 1000°. The alloy contains 20–35% by weight iron and 44–80% cobalt with up to 1% by weight miscellaneous components, and optionally, an amount of nickel. If nickel is included, to enable a cubically three-dimensionally centered structure to be maintained at room temperature, in accordance with the invention, it must be limited to an amount which is ascertained by a virtual linear interpolation between the values of 0% by weight nickel for an iron content of 20% by weight and 15% by weight nickel for an iron content of 35% by weight.

BRIEF DESCRIPTION OF THE DRAWINGS

This invention will be explained in greater detail with reference to the following figures in which.

If, in order to represent the resistance characteristics of materials for resistance elements having a positive temperature coefficient, we choose the temperature factor TF=R(1000° C.)/R(20° C.), which indicates the resistance ratio at a temperature of 1000° C. and at room temperature, then TF=4 for platinum, 7 for nickel and 12 for iron. On the other hand, temperature factors TF>12 can be achieved with the material according to the invention. Furthermore, where the material according to the invention is concerned, the resistance curve as a function of the temperature shows a pattern which favours short heating-up times.

Figure 1:
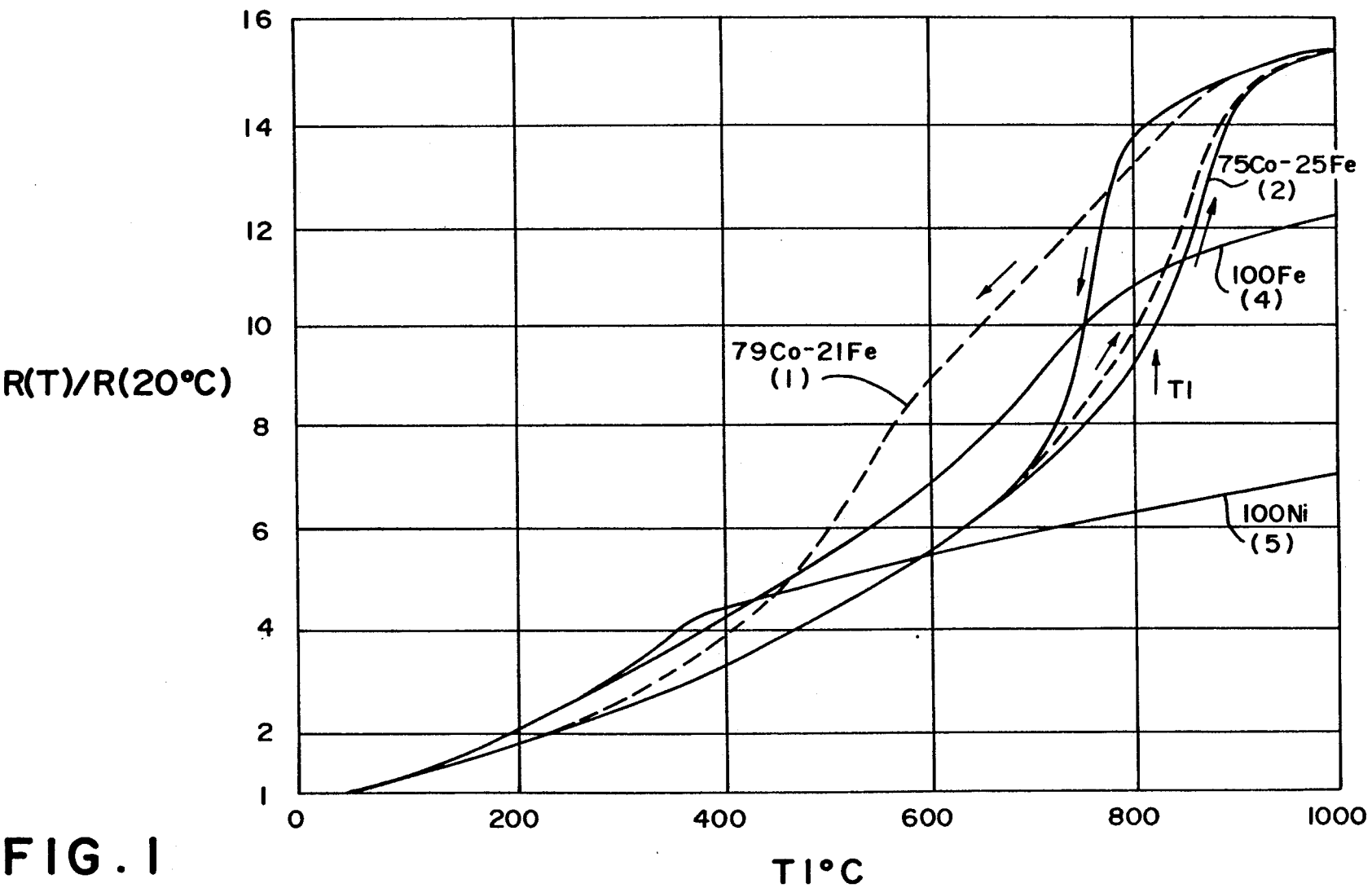
FIG. 1 is a graphic representation of the resistance ratio, R(t)/R(20° C.) as a function of temperature for materials made in accordance with the present invention and for materials made according to the state of art.
Figure 2:
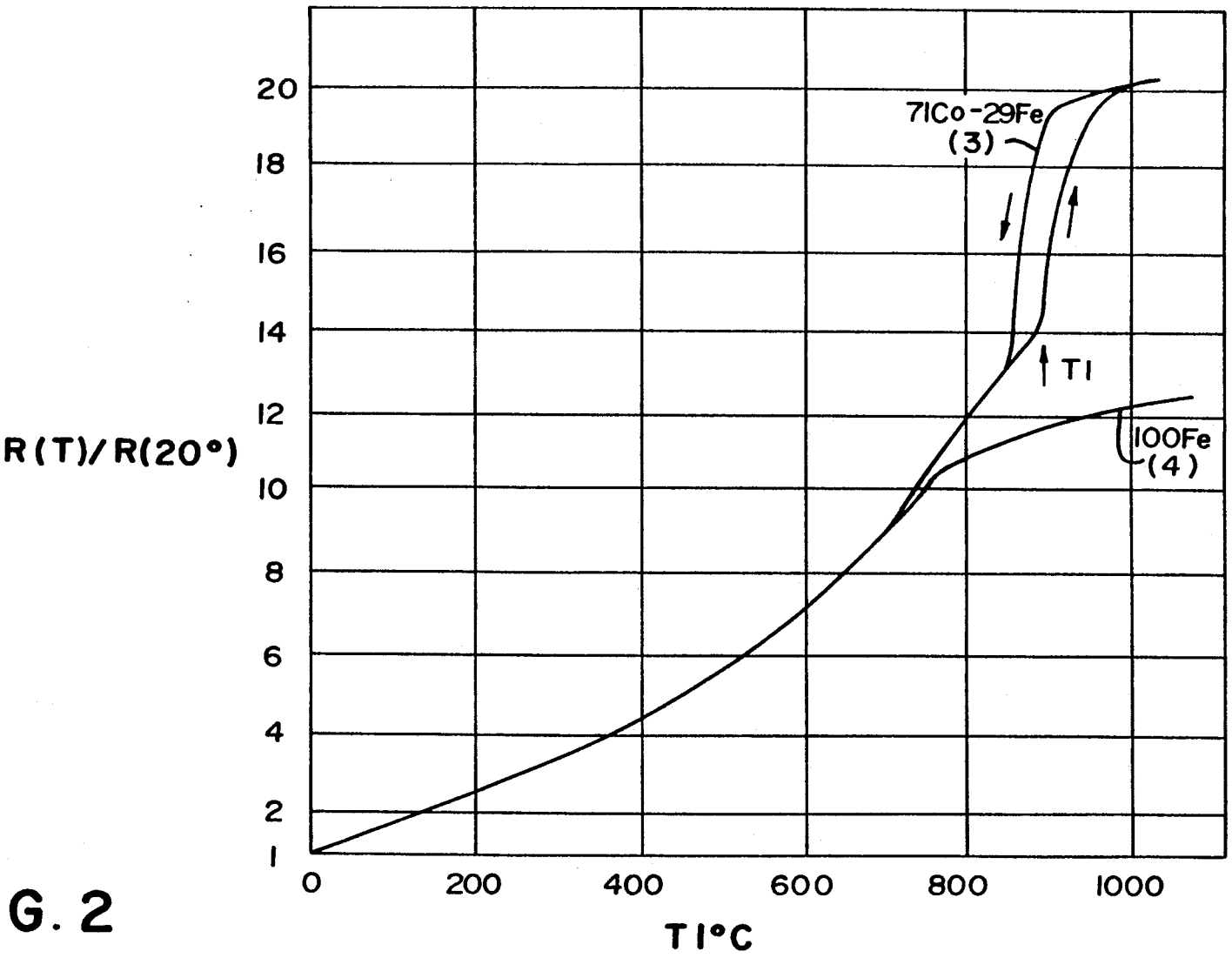
FIG. 2 is a further graphic representation of the resistance ratio as a function of temperature.

The invention will be explained in greater detail with reference to the examples of embodiment listed in the Table and, as illustrated in FIGS. 1 and 2, the resistance ratio R(T)/R(20° C.) as a function of the temperature for materials according to the invention and for materials according to the state of the art.

One essential advantage of the material according to the invention, when used for resistance elements, is the special pattern of the resistance curve as a function of the temperature. FIG. 1 shows the resistance ratio R(T)/R(20° C.) for an alloy consisting of 79% by weight cobalt and 21% by weight of iron (1), and for an alloy consisting of 75% by weight cobalt and 25% by weight iron (2). FIG. 2 shows the corresponding resistance ratio for an alloy with the composition of 71% by weight cobalt and 29% by weight iron (3). The pattern of the resistance ratio of the materials according to the invention shows a relatively minimal rate of rise up to the temperature T1 which is then followed by a steep, and to a certain extent even abrupt rise. Therefore, it encourages short heating-up times when temperatures of around 1000° C. have to be attained.

The cause of this particular pattern of the resistance curve lies in a phase conversion. At room temperature, the material according to the invention exhibits a cubically space-centered structure ($\alpha$), in the range between 750° and 900° C. there is a transition towards a cubically plane centered or two-dimensional centered structure ($\gamma$). The conversion temperature T1 is dependent upon the proportion of iron in the relevant alloy composition and it rises as the iron content increases. Upon cooling, the change from the cubically plane (two-dimensionally) centered structure ($\gamma$) to the cubically three-dimensionally centered structure ($\alpha$) takes place at a temperature which is lower than T1, producing an hysteresis curve. The hysteresis becomes smaller as the iron content increases.

Also, for purposes of comparison, FIGS. 1 and 2 further show in curve 4 the resistance ratio R(T)/R(20° C.) for iron and in FIG. 1, curve 5 shows the same for nickel, in other words for materials for resistance elements with a positive temperature coefficient according to the state of the art. Curve 5 for nickel flattens out already at a temperature of less than 400° C. while that for iron does so at a temperature of 800° C. This flattening out can be attributed to the Curie temperature having been reached.

The pattern of resistance ratios for the material according to the invention, on the other hand, initially shows a relatively flat rise so that higher heating up rates are possible. When the $\alpha/\gamma$ conversion temperature T1 is attained, the resistance then climbs sharply while the current intensity and thus the heat produced will correspondingly show a sharp drop. This self-regulating feature makes it possible quickly to attain the final temperature without the resistance element itself being damaged.

The $\alpha/\gamma$ conversion occurs in cobalt-iron alloys when the iron content is more than 20% by weight. The alloys can additionally also contain nickel, but only up to such a proportion that the cubically three-dimensionally centered structure is retained at room temperature. The admissible proportion of nickel rises as the iron content increases. The maximum nickel content at which the alloy exhibits a cubically three-dimensionally centered structure at room temperature can be ascertained virtually by linear interpolation between the values of about 0% by weight for an iron content of 20% by weight and 15% by weight with an iron content of 35% by weight. With an iron content of 25% by weight, the proportion of nickel cannot be more than 5% by weight and with an iron content of 30% by weight, it cannot exceed 10% by weight. In addition, the alloys may contain other elements, e.g. as processing additives with a proportion of up to 1% by weight.

The alloys according to the invention can easily be transformed while cold and can be readily worked to produce wire, strip or the like. Alloys with an iron content of more than 35% by weight on the other hand become increasingly brittle as a result of the orientation which they assume.

EXAMPLE

The Table lists the $\alpha/\gamma$ conversion temperature T1, the specific electrical resistance at room temperature and at 1000° C. and the resultant temperature factor TF both for materials according to the invention and also for iron and nickel.

Example a): An alloy consisting of 79% by weight cobalt and 21% by weight iron was produced by a sintering process. For this alloy composition, the $\alpha/\gamma$ conversion temperature is 750° C. From the values for specific resistance at room temperature and at 1000° C., the temperature factor TF can be calculated as 15.

Example b): For an alloy likewise produced by a sintering method, and consisting of 77% by weight cobalt and 23% by weight iron, the $\alpha/\gamma$ conversion temperature T1 is 780° C. while the temperature factor TF=16.

Example c): An alloy with a composition of 75% by weight cobalt and 25% by weight iron, likewise produced by a sintering process, had the following values: T1=825° C., TF=17.5.

Example d): An alloy of substantially the same composition as in Example c) was produced by a fusion process. For this purpose, 0.2% by weight manganese and 0.1% by weight silicon were incorporated as processing additives, the iron content was 25% by weight and the balance consisted of cobalt. The $\alpha/\gamma$ conversion temperature T1 was unaltered in comparison with the alloy from Example c), produced by sintering. Due to the processing additives, however, the specific resistance was higher. Consequently, also the temperature factor TF, at 15, was also somewhat lower than in the case of the sintered material in Example c), with no alloy additives.

Example e): A material with a composition of 71% by weight cobalt and 29% by weight iron was produced by sintering. The $\alpha/\gamma$ conversion temperature T1 amounted to 900° C. and a value for the temperature coefficient was ascertained: TF=20. Comparison with the above-mentioned examples which have a lower iron content shows that both the $\alpha/\gamma$ conversion temperature T1 and also the temperature factor TF increase with the proportion of iron.

Example f): A material produced by fusion and having a composition of 25% by weight iron, 5% by weight nickel, 0.2% by weight manganese and 0.1% by weight silicon as processing additives, and the balance cobalt, exhibited an $\alpha/\gamma$ conversion temperature T1 of 810° C. and a temperature factor TF of 17.

Example g): A material produced by fusion and having a composition of 30% by weight iron, 10% by weight nickel, 0.2% by weight manganese and 0.1% by weight silicon as processing additives, the balance cobalt, had an $\alpha/\gamma$ conversion temperature T1 of 850° C. and a temperature factor TF of 16.5. Therefore, even with alloys which have a proportion of nickel, it is possible to achieve high temperature coefficients TF. As the proportion of nickel further increases, however, the alloys even at room temperature start to exhibit a cubically two-dimensionally (plane) centred structure and the special characteristics of the resistance curve which is based on the transition from cubically three-dimensionally to cubically two-dimensionally (plane) centred structure is lost.

The examples listed in Table I demonstrate that it is possible with a material according to the invention to attain a temperature factor TF which is greater than 12, i.e. a temperature factor which is greater than in the case of the hitherto known materials for resistance elements having a positive temperature coefficient.

Particularly advantageously, the materials according to the invention can be used for glow plugs for diesel engines. They can be used directly as the heating element or as a regulating element in conjunction with a heating element having a lower positive temperature coefficient.

Further advantageous fields of application are for example use as a heating element, for example in domestic through-flow heaters or also use in temperature-actuated switches.

TABLE I

| | Composition | | | | | T1/ | Spec. resistance/ μΩcm | | |
|---|---|---|---|---|---|---|---|---|---|
| | Co | Fe | Ni | Mn | Si | °C. | at 20° C. | at 1000° C. | TF |
| (a) | 79 | 21 | — | — | — | 750 | 6.4 | 98 | 15 |
| (b) | 77 | 23 | — | — | — | 780 | 5.8 | 98 | 16 |
| (c) | 75 | 25 | — | — | — | 825 | 5.7 | 100 | 17.5 |
| (d) | 74.7 | 25 | — | 0.2 | 0.1 | 825 | 6.7 | 103 | 15 |
| (e) | 71 | 29 | — | — | — | 900 | 5.5 | 108 | 20 |
| (f) | 69.7 | 25 | 5 | 0.2 | 0.1 | 810 | 5.8 | 98 | 17 |
| (g) | 59.7 | 30 | 10 | 0.2 | 0.1 | 850 | 5.8 | 96 | 16.5 |
| (h) | — | — | 100 | — | — | — | | | 6.5 |
| (i) | — | 100 | — | — | — | 910 | | | 12 |

(a)–(g): alloys according to the invention
(h), (i): materials according to the state of the art The invention relates also to a glow plug for disposition in a combustion chamber of an air-compressing internal combustion engine, wherein the glow plug comprises a plug housing having a connection device for a glow current, a tube fixed on the plug housing and closed at an end remote from the plug housing, and a wire filament-like resistance element disposed in an insulating material within the tube; wherein said resistance element consists of front and rear series-connected resistance filaments, the rear resistance filament forming a regulating filament having a higher positive temperature resistance coefficient than the front resistance filament, and the front resistance element forming a heating element.

When the engine is cold, in other words below the self-starting temperature, air compressing internal combustion engines have to be started by means of glow plugs or heater plugs.

The aforesaid glow plugs take a certain time to heat up to their working temperature. Only then can the internal combustion engine be started. This period of time, also referred to as the preliminary heating time, is already quite short in the case of the aforementioned plug. Nevertheless, compared with a gasoline engine, it is still relatively long since the gasoline engine is immediately ready for starting.

Therefore, the constant endeavour is to shorten the preliminary heating time as far as possible.

Where the prior art sheathed-element glow plugs are concerned, the regulating filament is normally made from pure nickel, in which case the resistance ratio is about 7, related to a temperature ratio of 20°/1000° C., i.e., the resistance at 1000° C. is about 7 times as great as it is at 20° C. In this way, sheathed-element glow plugs can be produced with a heating up time of somewhere between 5 to 6 seconds; at the tip of the glow plug tube, then, the temperature is about 850° C. while after about 10 seconds, an equilibrium temperature sets in which is about 1140° C. at nominal voltage.

As practice has shown, the loading capacity of the filaments is reached at this temperature, so that in the case of a further theoretically possible shortening of the heating up time, by changes for instance in the filament geometry or by the structural configuration of the glow plug tube, the effective life of the glow plug can be substantially but adversely affected.

The problem according to this invention is resolved by the use of a regulating filament material having a resistance ratio, relative to a temperature range of 20°–1000° C., that is greater than approximately 7.5.

Figure 1A:
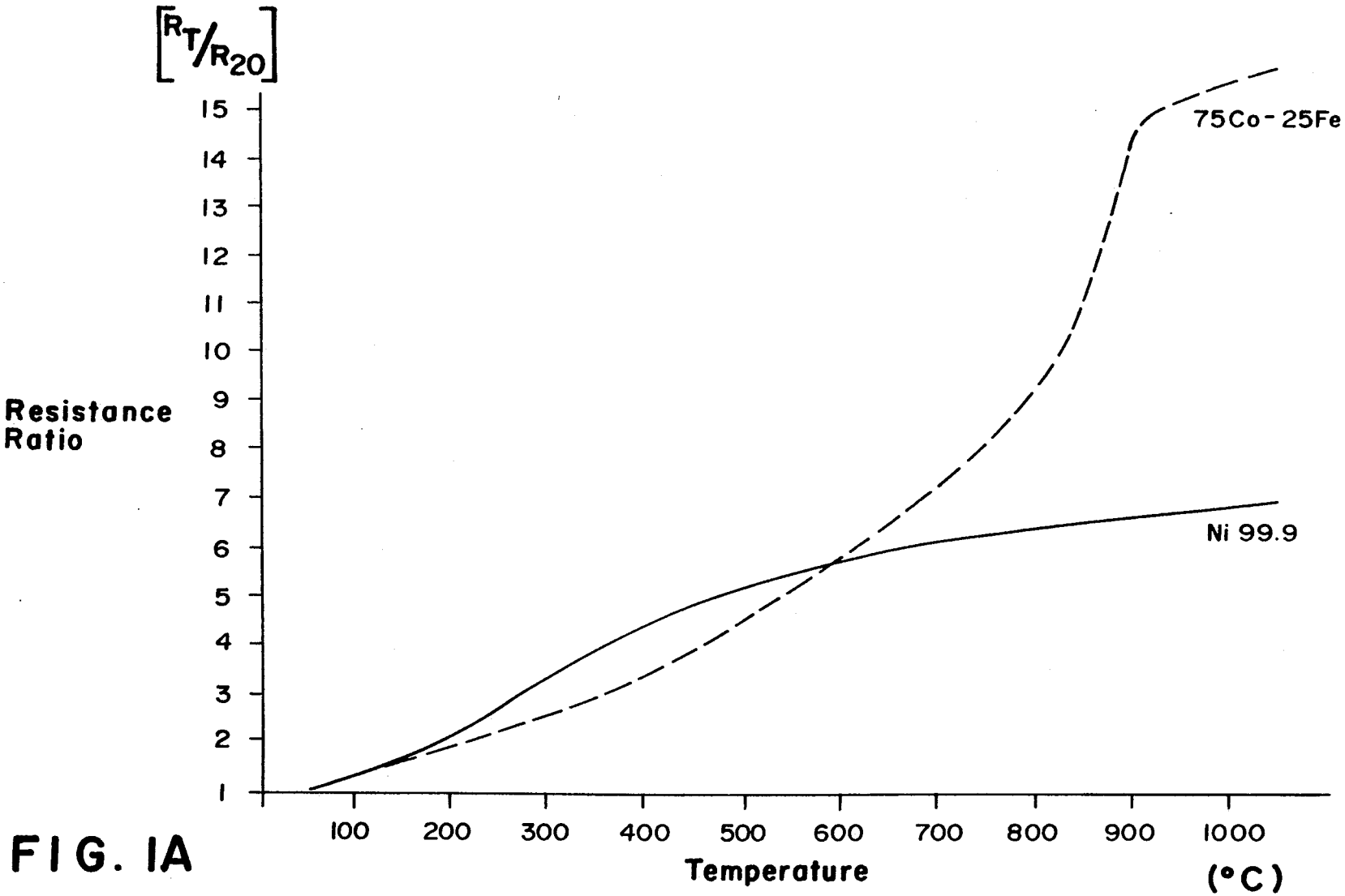
FIG. 1A is a graphic reproduction of the resistance ratio of various filament materials as a function of the temperature.

This invention will be explained in greater detail with reference to FIGS. 1A, 2A, and 3.

It has been found that theoretically by varying the filament geometry of the filament and the construction of the sheathed element, heating up times of less than 5 seconds can be achieved, although their effective life is completely inadequate for the desired purpose. It has been found that this is above all due to the fact that the rapid heating up period cannot be halted, so that the heater rod settles down to an equilibrium temperature of more than 1130° at a normal battery voltage after about 10 seconds, but as was found by the Applicants, this temperature has a decisively adverse affect on the effective life of such sheathed-element glow plugs.

If, on the other hand, the regulating filament used is a resistance filament with a higher resistance, it is not possible to achieve the desired shortening of the heating up time if the target equilibrium temperature is about 1000° C.

Surprisingly, it has been found that it is possible both to reduce the heating up time and also achieve a functionally viable effective life by using for the regulating filament a material having a resistance ratio of greater than about 7.5 and preferably greater than 12 and in particular of about 14.

Suitable materials are not, as known from the state of the art, pure nickel but are for example alloys of nickel-/iron and cobalt/iron, particularly cobalt/iron.

Materials which have been found to be particularly suitable are those which not only have the aforesaid resistance ratio but in which the variation in resistance occurs suddenly in a specific temperature range, i.e. varying in a not substantially linear fashion as with pure nickel but very rapidly in relation to the rest of the pattern of the curve, in the range from 600° to 900° C. This is demonstrated by the curves in FIG. 1A, in which the pattern of the resistance ratio is shown diagrammatically as a function of the temperature of the materials mentioned.

Figure 2A:
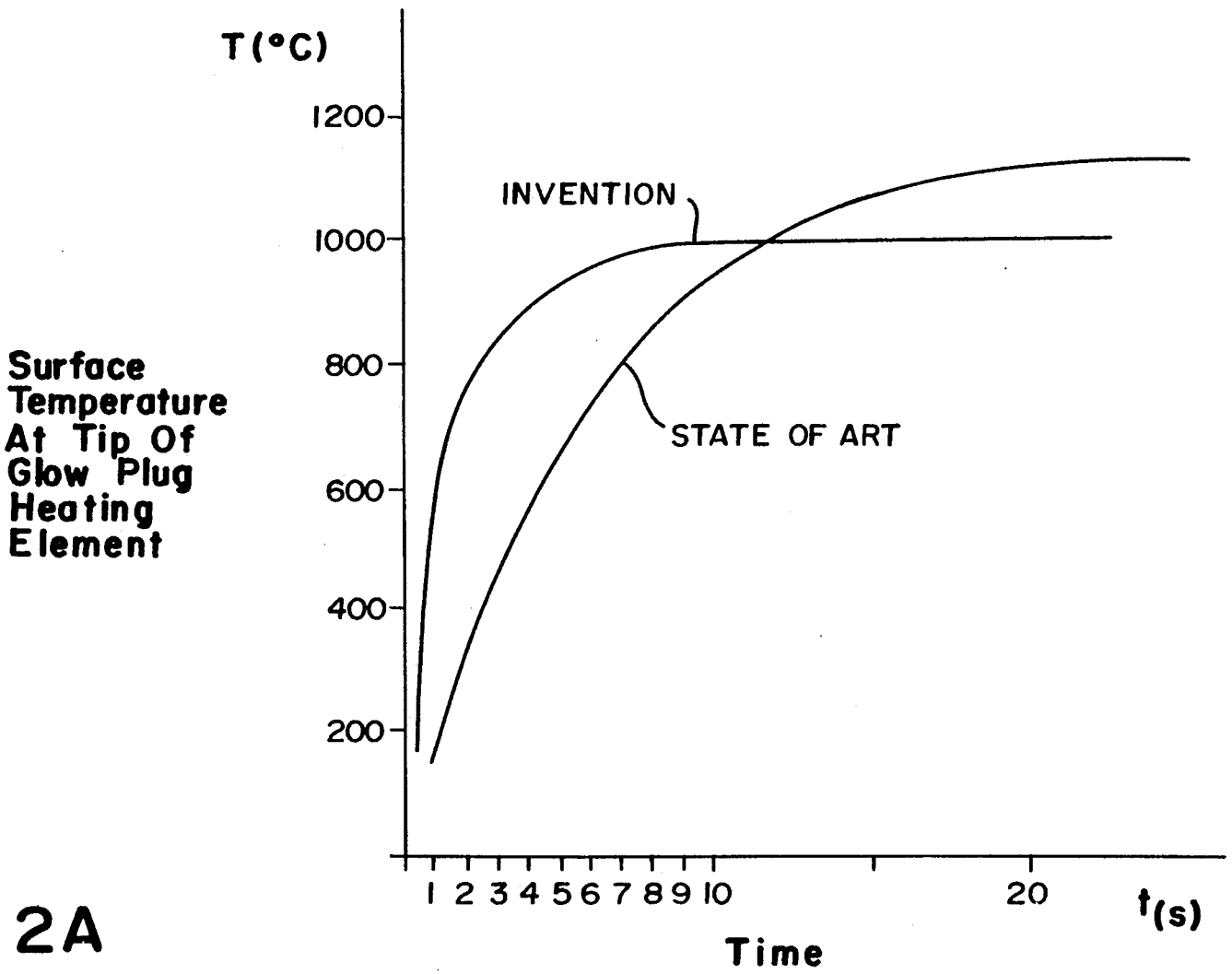
FIG. 2A is a graphic representation of the temperature of the heating rod surface as a function of the time and FIG. 3 shows a preferred embodiment of sheathed-element glow plug according to the invention.

Sheathed-element glow plugs constructed according to the invention correspondingly show the behaviour illustrated in FIG. 2A with regard to their surface temperature and as a function of the time factor. Whereas in the case of the example shown the sheathed-element glow plug from the state of the art has reached a temperature at the tip of the sheathed element of about 850° C. after some 8 seconds, the sheathed-element glow plug according to the invention reaches this temperature after about 3 to 4 seconds. Furthermore, the illustration shows that the sheathed-element glow plug according to the invention is very sharply "halted" in terms of its surface temperature and settles down according to FIG. 2A to an equilibrium temperature of about 1000° C., whereas the prior art sheathed-element glow plug settles down to an equilibrium temperature of somewhat above 1150° C.

The low equilibrium temperature of the glow plug according to the invention improves not only the effective life of the glow plug quite considerably but above all it also means that while the engine is running and is at a higher generator voltage (up to 13 volts at the plug), secondary heating is possible with this plug without destroying the heating and regulating filament; this possibility of secondary heating is quite significant as a way of diminishing harmful substances in the exhaust gas from diesel engines. In this way, it is possible to dispense with the complicated electrical or electronic control arrangements which would otherwise need to be provided in the case of secondary heating (afterglowing).

Figure 3:
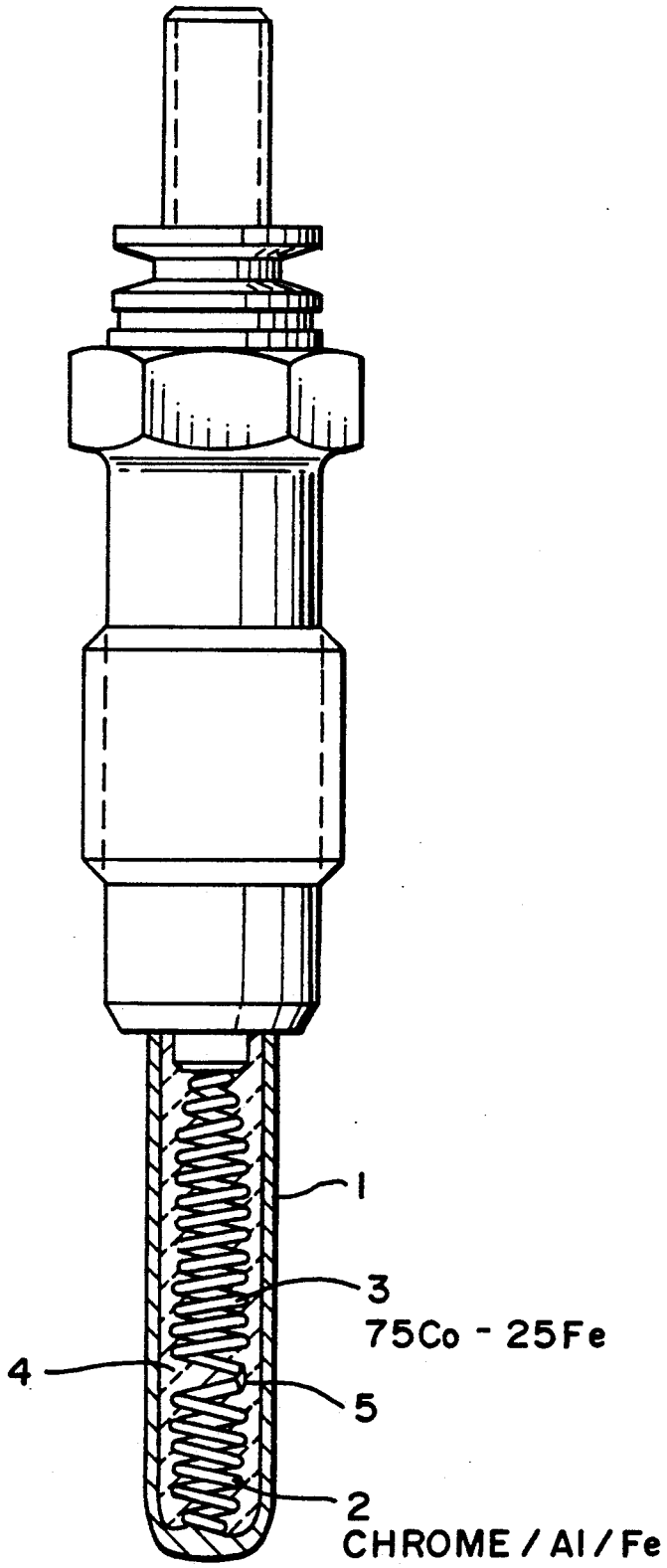

A typical embodiment of the sheathed-element glow plug according to the invention is shown in FIG. 3.

The glow plug element 1, constructed as a closed glow plug tube, normally consists of a corrosion-resistant material, preferably Inconel 600 or 601.

Embedded in a readily heat-conductive insulating material 4 (for example magnesium oxide) in this protective tube there is a combination filament including portions 2 and 3.

The front portion 2 of the serially disposed filaments is described as the heating filament and consists of wire stock having a low positive or negative temperature coefficient, preferably a chrome/aluminum/iron wire. The diameter of the wire is usually 0.3 to 0.5 mm.

The heating filament 2 is connected to the regulating filament 3 normally by welding. In this case, the regulating filament consists of a cobalt/iron alloy, the proportion of cobalt in the alloy being about 75% while the balance is iron; according to the invention, it is possible in this way to use a material of which the resistance characteristic is adapted to the application of a glow plug. This regulating filament 3 has according to the invention initially a lower increase in resistance, while the resistance in the region of the filament wire temperature rises sharply from about 400° to about 900° C.

Likewise according to the invention, the desired equilibrium temperature settles down after about 8 seconds. The glow temperature of about 850° C. is attained already after 2 to 5 seconds. The diameter of the regulating filament in this example is about 0.3 to 0.4 mm.

Examples of alloys which can be used according to the invention will emerge from the following table:

| | Composition | | | | | | Spec. resistance/ μΩcm | | |
|---|---|---|---|---|---|---|---|---|---|
| | | | | | | | at | at | |
| | Co | Fe | Ni | Mn | Si | T1/°C. | 20° C. | 1000° C. | TF |
| (a) | 79 | 21 | — | — | — | 750 | 6.4 | 98 | 15 |
| (b) | 77 | 23 | — | — | — | 780 | 5.8 | 98 | 16 |
| (c) | 75 | 25 | — | — | — | 825 | 5.7 | 100 | 17.5 |
| (d) | R | 25 | — | 0.2 | 0.1 | 825 | 6.7 | 103 | 15 |
| (e) | 71 | 29 | — | — | — | 900 | 5.5 | 108 | 20 |
| (f) | R | 25 | 5 | 0.2 | 0.1 | 810 | 5.8 | 98 | 17 |
| (g) | R | 30 | 10 | 0.2 | 0.1 | 850 | 5.8 | 96 | 16.5 |

We claim:

1. A material for an electrical resistance element having a high positive temperature coefficient of electrical resistance, wherein, in order to achieve a high ratio of resistance values at temperatures above 750° C. as well as at room temperature and to achieve an initial nonlinear rise in resistance that is gradual in comparison to a following steep rise in resistance with increases in temperature above 750° C. with an abrupt transition therebetween, said material comprises an alloy which exhibits a cubically three-dimensionally centered structure at room temperature which, upon heating in the range between room temperature and 1000° C., merges into a cubically two-dimensionally centered structure; and wherein said alloy consists of 20–35% by weight iron, up to 1% by weight miscellaneous components, and 44–80% by weight cobalt.

2. A material according to claim 1, wherein said material additionally contains an amount of nickel and, wherein, in order to achieve a structure which is cubically three-dimensionally centered at room temperature, the nickel content is directly proportional to iron content.

3. A material according to claim 2, wherein said material contains an amount of nickel and, wherein the maximum nickel content can be ascertained by virtually linear interpolation between the values 0% by weight nickel for an iron content of 20% by weight and 15% by weight nickel for an iron content of 35% by weight.

4. A glow plug for disposition in a combustion chamber of an air-compressing internal combustion engine, wherein said glow plug comprises a plug housing having a connection device for a glow current, a tube fixed on the plug housing and closed at an end remote from the plug housing, and a wire filament-like resistance element disposed in an insulating material within the tube; wherein said resistance element consists of front and rear series-connected resistance filaments, the rear resistance filament forming a regulating filament having a higher positive temperature resistance coefficient than the front resistance filament, and the front resistance element forming a heating filament; and wherein the regulating filament is formed of a material having a resistance ratio, in a temperature range of 20 to 1000° C., of greater than approximately 7.5 wherein said material is a cobalt/iron alloy having 20–35% by weight iron; and wherein the material has a resistance ratio (20°/1000° C.) which is no more than approximately 7.5 in the range from about 100° C. up to temperature in a range between about 400° C. to about 600° C.; and from said temperature in the range from 400° C. to 600° C. up to about 900° C., the ratio rises sharply to values from about 7.5 up to greater than 12.

5. A glow plug according to claim 4, wherein said material forming said regulating filament comprises, in addition to the 20–35% by weight iron, 0–1% by weight miscellaneous components, 44–80% by weight cobalt the resistance ratio to be greater than 12.

6. A glow plug according to claim 5, wherein the resistance ratio is about 14.

7. A glow plug according to claim 5 wherein said material additionally contains an amount of nickel and wherein the regulating filament, nickel content is directly proportional to the iron content in a virtually linear manner between 0% by weight nickel for an iron content of 20% by weight and 15% by weight nickel for an iron content of 35% by weight.

8. A glow plug according to claim 4, wherein the regulating filament material shows an abrupt variation in resistance at temperatures of the regulating filament from about 400 ° up to about 900° C.

9. A glow plug according to claim 8, wherein the range of abrupt variation in resistance of the regulating filament wire extends from temperatures of about 600° to about 900° C.

10. A glow plug according to claim 4, wherein the regulating filament is constructed of at least one piece from at least one material, wherein said material additionally comprises 0–1% by weight miscellaneous components, 44–80% by weight cobalt and up to 15% nickel.

* * * * *

UNITED STATES PATENT AND TRADEMARK OFFICE

CERTIFICATE OF CORRECTION

PATENT NO. : 5,093,555

DATED : March 3, 1992

INVENTOR(S) : Bertram Dupuis, Max Endler, Paul Bauer, Gernot Hausch and Mechthild Schieck It is certified that error appears in the above-identified patent and that said Letters Patent is hereby corrected as shown below:

On the Title page, item [75] Inventors, after "Steinheim", insert

--;Gernot Hausch, Langenselbold; Mechthild Schieck, Kahl--

Signed and Sealed this

Tenth Day of August, 1993

*Attest:*

*Attesting Officer*

Michael K. Kirk

MICHAEL K. KIRK

*Acting Commissioner of Patents and Trademarks*